US011450956B2

(12) United States Patent
Jang

(10) Patent No.: US 11,450,956 B2
(45) Date of Patent: Sep. 20, 2022

(54) ANTENNA PHASE SHIFTER WITH INTEGRATED DC-BLOCK

(71) Applicant: JOHN MEZZALINGUA ASSOCIATES, LLC, Liverpool, NY (US)

(72) Inventor: Taehee Jang, Fayetteville, NY (US)

(73) Assignee: John Mezzalingua Associates, LLC, Liverpool, NY (US)

( * ) Notice: Subject to any disclaimer, the term of this patent is extended or adjusted under 35 U.S.C. 154(b) by 0 days.

(21) Appl. No.: 16/979,923

(22) PCT Filed: Mar. 13, 2019

(86) PCT No.: PCT/US2019/022047

§ 371 (c)(1),
(2) Date: Sep. 11, 2020

(87) PCT Pub. No.: WO2019/178224

PCT Pub. Date: Sep. 19, 2019

(65) Prior Publication Data

US 2021/0013605 A1 Jan. 14, 2021

Related U.S. Application Data

(60) Provisional application No. 62/642,066, filed on Mar. 13, 2018.

(51) Int. Cl.
*H01Q 3/32* (2006.01)
*H01Q 21/00* (2006.01)
(Continued)

(52) U.S. Cl.
CPC ..... *H01Q 3/32* (2013.01); *H01Q 1/1285* (2013.01); *H01Q 1/325* (2013.01)

(58) Field of Classification Search
CPC ..... H01Q 3/32; H01Q 3/36; H01Q 21/00; H01Q 1/12; H01Q 1/1285; H01Q 1/32; H01Q 1/325; H01P 1/18; H01P 1/184
See application file for complete search history.

(56) References Cited

U.S. PATENT DOCUMENTS 5,801,600 A * 9/1998 Butland ..... H01Q 3/32 333/127
6,573,875 B2 6/2003 Zimmermann et al.
(Continued)

FOREIGN PATENT DOCUMENTS

| | | |
|---|---|---|
| CN | 104 810 577 | 7/2015 |
| KR | 2005 0008882 | 1/2005 |
| WO | 2017-218396 | 12/2017 |

OTHER PUBLICATIONS

International Search Report and Written Opinion dated Jun. 28, 2019, from International Application No. PCT/ US2019/022047, 9 pages.

(Continued)

*Primary Examiner* — Tho G Phan
(74) *Attorney, Agent, or Firm* — Meunier Carlin & Curfman LLC

(57) ABSTRACT

Disclosed is an antenna phase shifter that comprises an outer conductive trace, an inner conductive trace, a wiper arm having a pivot point, and a capacitive coupler that capacitively couples an input port to the wiper arm conductive trace and capacitively couples the input port to a phase reference port. The capacitive coupler provided DC blocking between the input port and the phase reference port, and the input port may be coupled to a Bias-T such that the DC component present at the input port may be coupled to the Bias-T to drive the phase shifter wiper arm motor. In
(Continued)

addition, the capacitive coupler provided constant capacitance while the wiper arm rotates.

13 Claims, 9 Drawing Sheets

(51) Int. Cl.

| | |
|---|---|
| ***H01P 1/18*** | (2006.01) |
| ***H01Q 1/12*** | (2006.01) |
| ***H01Q 1/32*** | (2006.01) |

(56) References Cited

U.S. PATENT DOCUMENTS

| | | | | |
|---|---|---|---|---|
| 6,850,130 | B1 | 2/2005 | Maximilian et al. | |
| 7,170,466 | B2 * | 1/2007 | Janoschka | H01P 1/184 333/156 |
| 7,233,217 | B2 * | 6/2007 | Phillips | H01P 1/184 333/116 |
| 7,298,233 | B2 | 11/2007 | Zimmerman | |
| 7,463,190 | B2 * | 12/2008 | Zimmerman | H01Q 3/32 342/372 |
| 9,431,703 | B1 * | 8/2016 | Dandlberger | H01P 5/028 |
| 11,108,154 | B2 * | 8/2021 | Litteer | H01Q 21/205 |
| 2003/0076198 | A1 | 4/2003 | Phillips et al. | |
| 2005/0046514 | A1 | 3/2005 | Janoschka | |
| 2006/0273864 | A1 | 12/2006 | Zimmerman et al. | |
| 2008/0024385 | A1 | 1/2008 | Zimmerman | |
| 2009/0189826 | A1 | 7/2009 | Timofeev et al. | |
| 2017/0244157 | A1 | 8/2017 | Helmut et al. | |

OTHER PUBLICATIONS

Supplementary International Search Report and Written Opinion dated Jun. 3, 2020, from International Application No. PCT/US2019/022047, 15 pages.

* cited by examiner

ANTENNA PHASE SHIFTER WITH INTEGRATED DC-BLOCK

CROSS REFERENCE TO RELATED APPLICATIONS

This application is a no-provisional of Application Ser. No. 62/642,066, filed Mar. 13, 2018, which is hereby incorporated by this reference in its entirety.

BACKGROUND OF THE INVENTION

Field

The present invention relates to wireless communications, and more particularly, to antennas that employ integrated phase shifters.

Related Art

Cellular antennas typically have a Remote Electrical Tilt (RET) mechanism that provides a controlled phase delay differential between antenna dipoles (or dipole clusters) along a vertical axis. In doing so, the RET mechanism enables tilting the antenna gain pattern along the vertical axis, which has the effect of sweeping the gain pattern toward or away from the cell tower on which the antenna is mounted. This allows a network operator to expand or contract the antenna's gain pattern, which may be important for controlling cellular coverage and preventing interference with the gain patterns nearby antennas. RET devices typically employ one or more phase shifters to perform this function.

FIG. 1 illustrates a conventional phase shifter 100. Phase shifter 100 comprises an outer conductive trace 105, an inner conductive trace 110, and a reference conductive trace 120. Phase shifter 100 further comprises a wiper arm 125, which includes a wiper arras trace 130, an inner wiper arm capacitive contact 135, and an outer wiper arm capacitive contact 140. Reference conductive trace 120 is electrically coupled to wiper arm trace 130 via pivot point contact 115. Reference conductive trace 120 is coupled to an RF signal input at Port 1, and to phase reference port (or middle port) at Port 4. Further illustrated in FIG. 1 is wiper arm motor 145, which in a conventional phase shifter 100 must be powered by a standalone DC signal input 150.

FIG. 2 illustrates a how a phase shifter may be employed in a RET system to control the tilt of a cellular antenna gain pattern. Illustrated in FIG. 2 is an antenna array face 200 having a plurality of dipole sets 210 arranged along a vertical axis. Further illustrated a phase shifter, with Ports 1-6. Port 1 may be coupled to an RF signal input source, and the remaining Ports 2-6 are coupled to a respective dipole set 210 via corresponding signal lead 202-206.

FIG. 2 provides a very simplified depiction of three exemplary antenna gain patterns 220*a*, 220*b*, and 220*c*. According to the principles of an antenna phase shifter, the angle of wiper arm 125 imparts different phase changes to the RF signal from RF signal input at Port 1 to each of ports 2, 3, 5, and 6. The phase at Port 4 (the phase reference port) remains unchanged. The differential phase shifts imparted on the RF signal as a function of Port results in a tilting of the antenna gain pattern such that a given position of wiper arm 125 corresponds to a specific tilt angle of the antenna gain pattern.

One disadvantage of conventional phase shifter 100 is that it requires a separate dedicated DC power line to drive wiper arm motor 145. One solution to this is to integrate a Bias-T circuit into the phase shifter so that, given a combined RF and DC signal at the RF signal source, and split off a portion of that DC signal to dedicate it to driving the wiper arm motor.

FIG. 3 illustrates another conventional phase shifter 300, which incorporates a Bias-T circuit 305, which splits a portion of the DC signal to drive wiper arm motor 145. This solution creates two problems. First, a portion of the DC signal remains with the RF signal that is applied to the phase reference Port 4. One solution to this is to add an additional DC block to either side of Port 4. This adds complexity and cost to phase shifter 300, and increases the real estate taken up on an array antenna. Second, by splitting the DC signal, less power is available to wiper arm motor 145, and power is wasted at the DC block that might otherwise be channeled to wiper arm motor 145.

FIG. 4 illustrates a conventional wiper arm pivot point 115. As illustrated, the input signal from input at port 1, coupled via reference conductive trace 120, is directly coupled to wiper arm pivot point 115 and middle port trace 410, which is directly coupled to reference port 4. Accordingly, the DC portion of the input signal is directly coupled to Bias-T 305 and reference port 4.

Accordingly, what is needed is a phase shifter that more efficiently powers its wiper arm motor, with fewer additional components, while providing RF signals to ports 2-6 with minimal insertion loss.

SUMMARY OF THE INVENTION

An aspect of the present invention involves a phase shifter for an antenna. The phase shifter comprises an outer conductive trace, an inner conductive trace, a wiper arm having a wiper arm conductive trace wherein the wiper arm has a pivot point, and a capacitive coupler. The capacitive coupler capacitively couples the input port to a phase reference port to provide DC blocking to the phase reference port.

BRIEF DESCRIPTION OF THE DRAWINGS

The accompanying figures, which are incorporated herein and form part of the specification, illustrate an antenna phase shifter with integrated DC block. Together with the description, the figures further serve to explain the principles of the antenna phase shifter with integrated DC block described herein and thereby enable a person skilled in the pertinent art to make and use the antenna phase shifter with integrated DC block.

DESCRIPTION OF EXEMPLARY EMBODIMENTS

Reference will now be made in detail to embodiments of the antenna phase shifter with integrated DC block with reference to the accompanying figures.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

Figure 1:
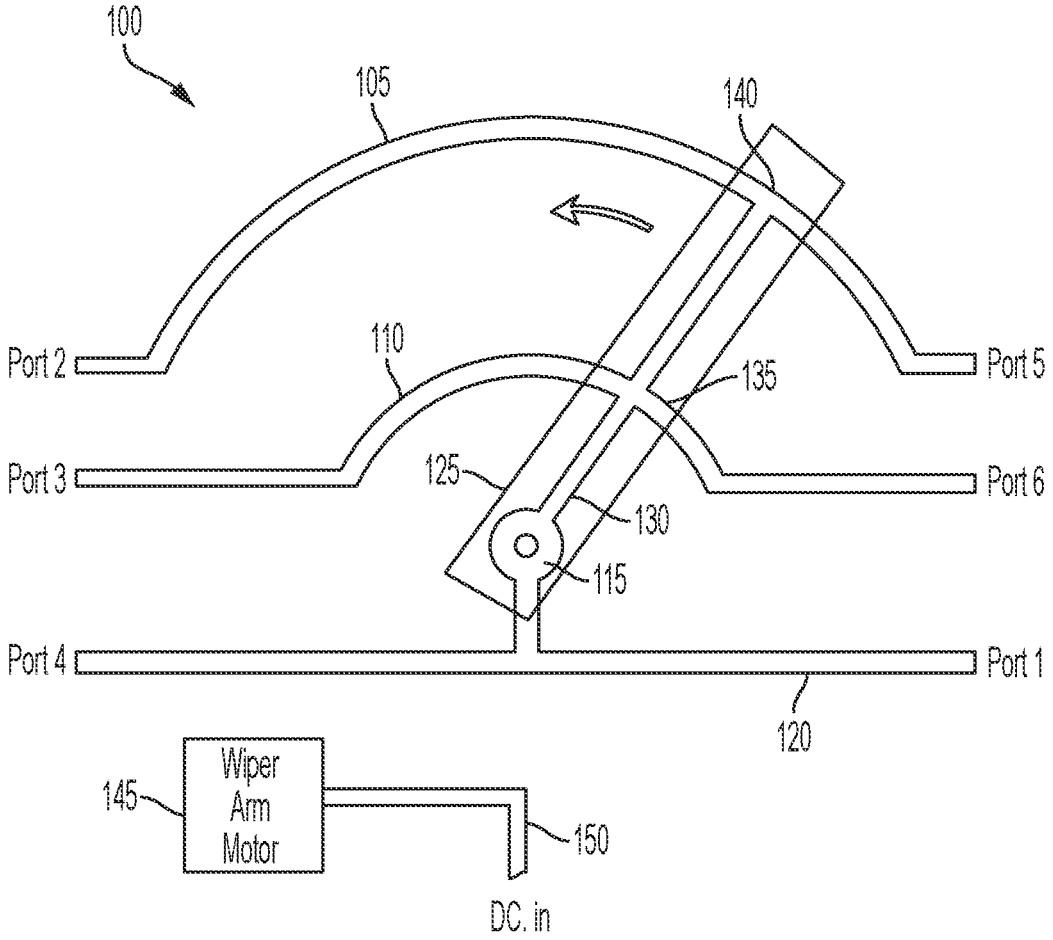
FIG. 1 PRIOR ART
FIG. 1 illustrates a conventional phase shifter.
Figure 2:
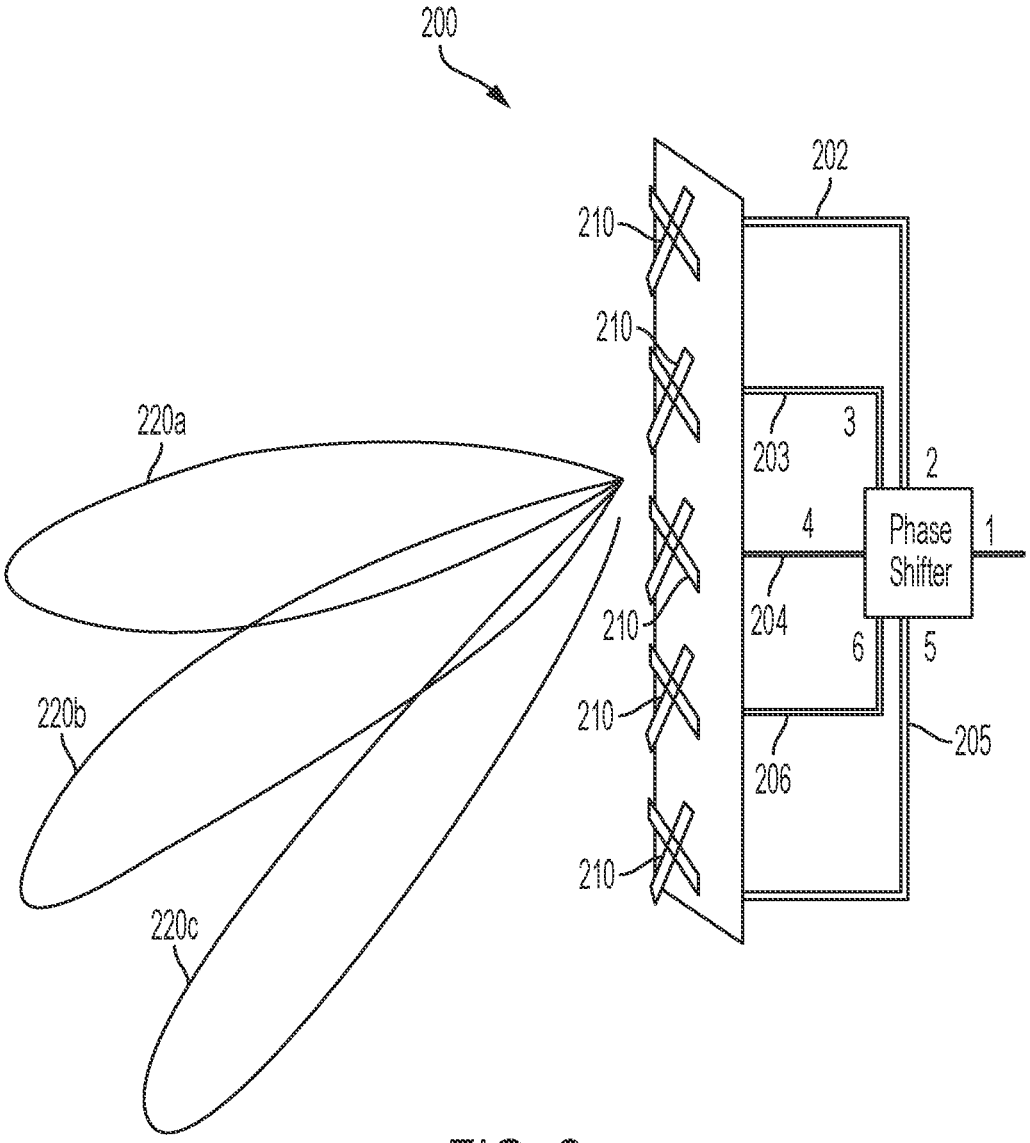
FIG. 2 PRIOR ART
FIG. 2 illustrates an array face that uses a phase shifter to tilt its antenna gain pattern along a vertical axis.
Figure 3:
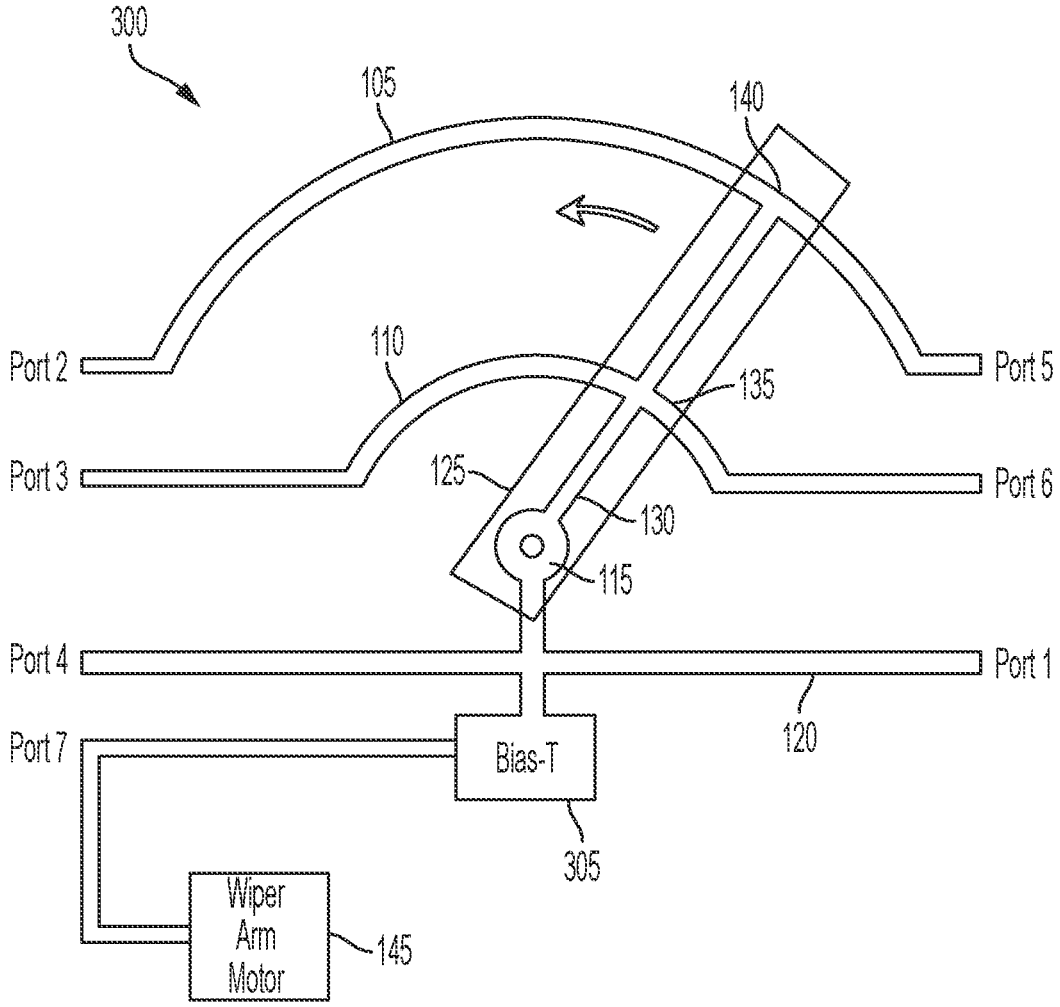
FIG. 3 PRIOR ART
FIG. 3 illustrates a conventional phase shifter that incorporates a Bias-T circuit.
Figure 4:
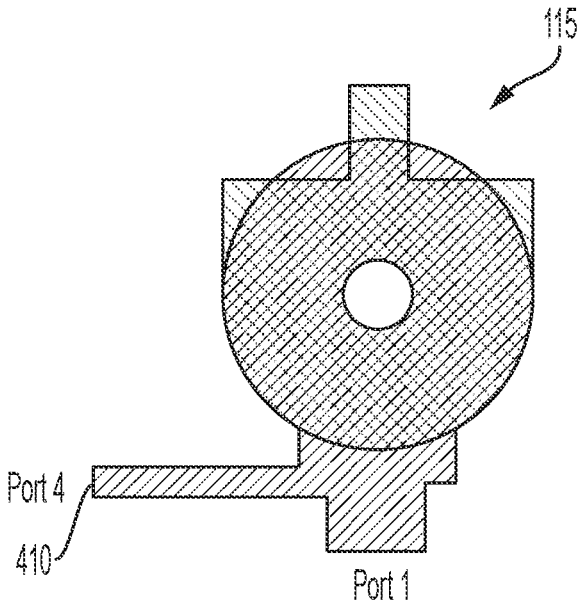
FIG. 4 PRIOR ART
FIG. 4 illustrates a conventional wiper arm pivot point.
Figure 5:
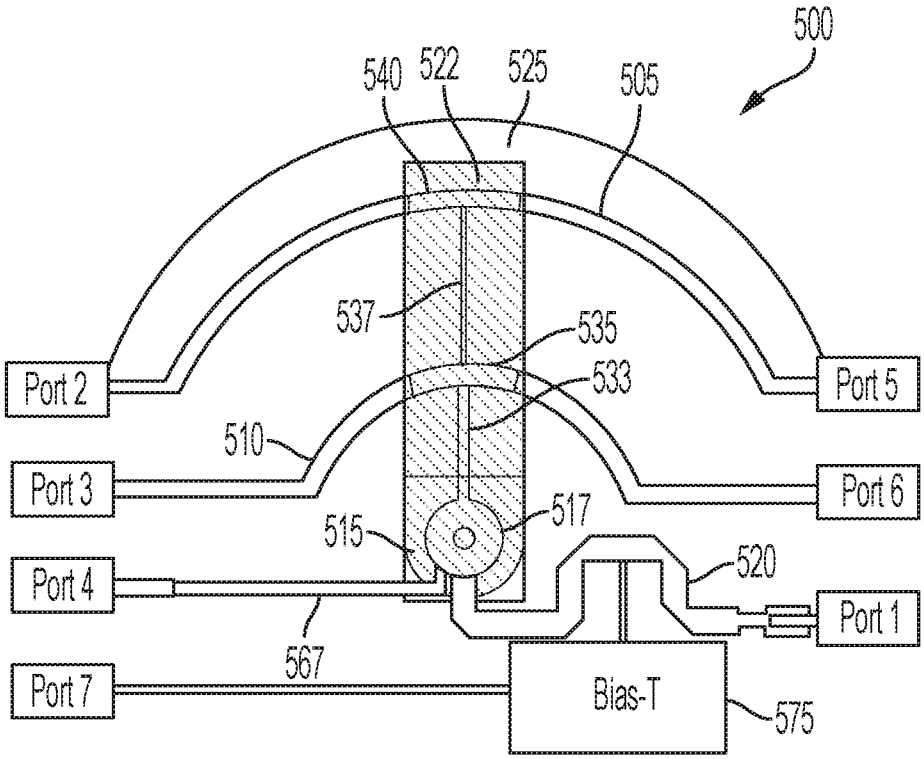
FIG. 5 illustrates an exemplary phase shifter according to the disclosure.

FIG. 5 illustrates an exemplary phase shifter 500 according to the disclosure. Phase shifter 500 includes outer conductive trace 505 and inner conductive trace 510, which may be substantially similar to outer and inner conductive traces 105/110 of conventional phase shifters 100/300. Phase shifter 500 further includes wiper arm 525 having a wiper arm conductive trace pattern 522 and a pivot point capacitive coupler 515. Wiper arm 525 conductive trace pattern 522 has a pivot point capacitor plate 517 of pivot point capacitive coupler 515, an inner arm trace 533, an inner trace capacitor plate 535, an outer arm trace 537, and an outer trace capacitor plate 540. Inner trace capacitor plate 535 and outer trace capacitor plate 540 respectively capacitively couple to inner conductive trace 510 and outer conductive trace 505.

As illustrated, input Port 1 is coupled to input trace 520, which is in turn coupled to both Bias-T 575 and pivot point capacitive coupler 515 (further described below). Also capacitively coupled to pivot point capacitive coupler 515 is phase reference port (or middle port) 4, via reference port trace 567.

Given that the pivot point coupling in exemplary phase shifter 500 is capacitive and not a direct conductive contact, no DC portion of the signal input from input Port 1 is conducted to phase reference port 4, and thus all of the DC portion of the input signal is fed to Bias-T 575 for powering the wiper arm motor 145.

The function of phase shifter 500, how it divides the phase of the RF signal portion of the input signal from input Port 1 to each of ports 2, 3, 5, and 6, is substantially similar to that of conventional phase shifters 100/300.

Figure 6:
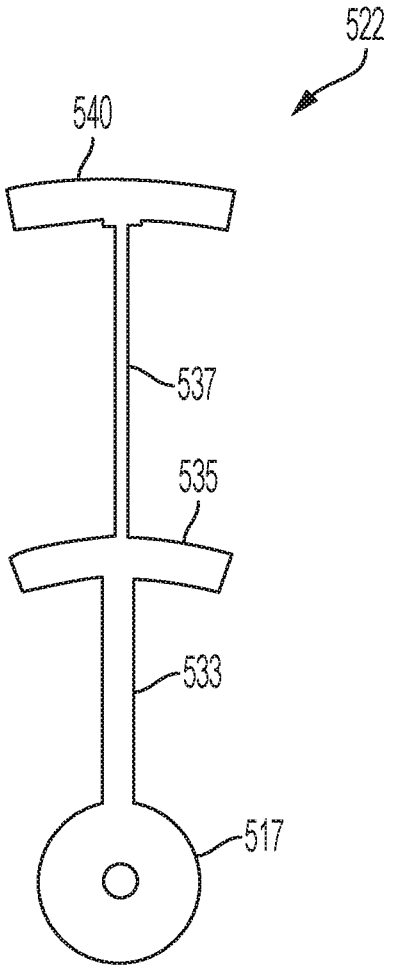
FIG. 6 illustrates an exemplary wiper arm conductive trace pattern according to the disclosure.

FIG. 6 illustrates an exemplary wiper arm conductive trace pattern 522 according to the disclosure. As discussed above with reference to FIG. 5, wiper arm 525 conductive trace pattern 522 has a pivot point capacitor plate 517 of pivot point capacitive coupler 515, an inner arm trace 533, an inner trace capacitor plate 535, an outer arm trace 537, and an outer trace capacitor plate 540. As illustrated, the width of inner arm trace 533 is wider than outer arm trace 537. This is to provide amplitude tapering between reference port 570, inner conductive trace 510 ports 3/6, and outer conductive trace 505 ports 2/5, such that the amplitude at ports 2/5 is less than the amplitude at ports 3/6, which is less than the amplitude at reference port 465. This design feature improves the quality of gain pattern 220*a/b/c*.

Figure 7:
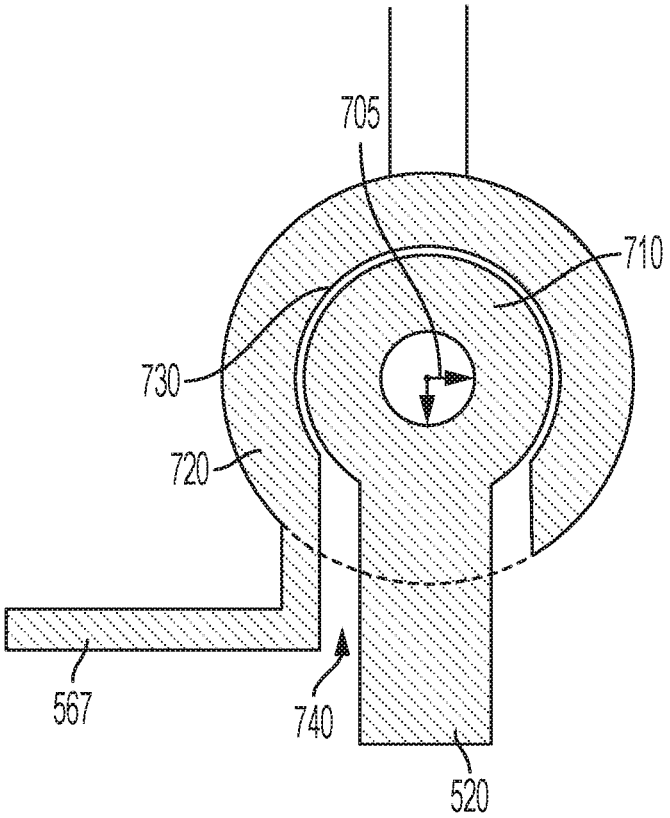
FIG. 7 illustrates a wiper arm pivot point capacitive coupler according to the disclosure.

FIG. 7 illustrates wiper aria capacitive coupler 515, including the capacitor structure underlying the pivot point capacitor plate 517. The pivot point capacitor plate 517 has symmetric shape to provide the same amplitude and phase while the wiper arm is rotating. Wiper arm capacitive coupler 515 includes an input port conductor plate 710 and a reference port conductor plate 720, both of which are concentric with a wiper arm pivot axis 705. Also illustrated is a first gap 730 disposed between input port conductor plate 710 and a reference port conductor plate 720. Also illustrated is a second gap 740 that is disposed between input trace 520 and reference port trace 567.

The widths of input port conductor plate 710 and reference port conductor plate 720, and that of first gap 730 may be designed such that a resulting capacitance between input port conductor plate 710 and reference part conductor plate 720 is substantially equal to the capacitance of the combination of wiper arm inner trace capacitor plate 535 and inner conductive trace 510, and to the capacitance of the combination of wiper arm outer capacitor plate 540 and outer conductive trace 505. This way, not only is DC blocking achieved between input part trace 520 and reference port trace 567, but that the RF signal at reference port 4 is not distorted relative to the RF signals present at ports 2, 3, 5, and 6.

Further to the design of wiper arm capacitive coupler 515 is that the combination of first gap 730 and second gap 740 enables consistent capacitive coupling between input port conductor plate 710 and reference port conductor plate 720 as a function of wiper arm angle.

An additional advantage of the wiper arm capacitive coupler 515 of the disclosure is that it provides protection to the electronics of the antenna in the event of a lightning strike. For example, if lightning were to strike one or more antenna elements coupled to reference port 4, the surge in current would not pass through unimpeded to input Port 1, thereby severely damaging the entire antenna and connected communication system. With wiper arm capacitive coupler 515, any damage would be isolated to those elements directly coupled to reference port 4.

In a variation to exemplary phase shifter 500, Bias-T 575 may be omitted, and the motor for wiper arm 525 may be directly driven by a separate power supply (not shown). In this case, the signal input at input Port 1 does not have a DC component. Further to this variation, wiper arm capacitive coupler 515 still offers the benefit of RF coupling to reference port 4 that more evenly matches those at ports 2, 3, 5, and 6, and also provides lightning strike protection.

Figure 8:
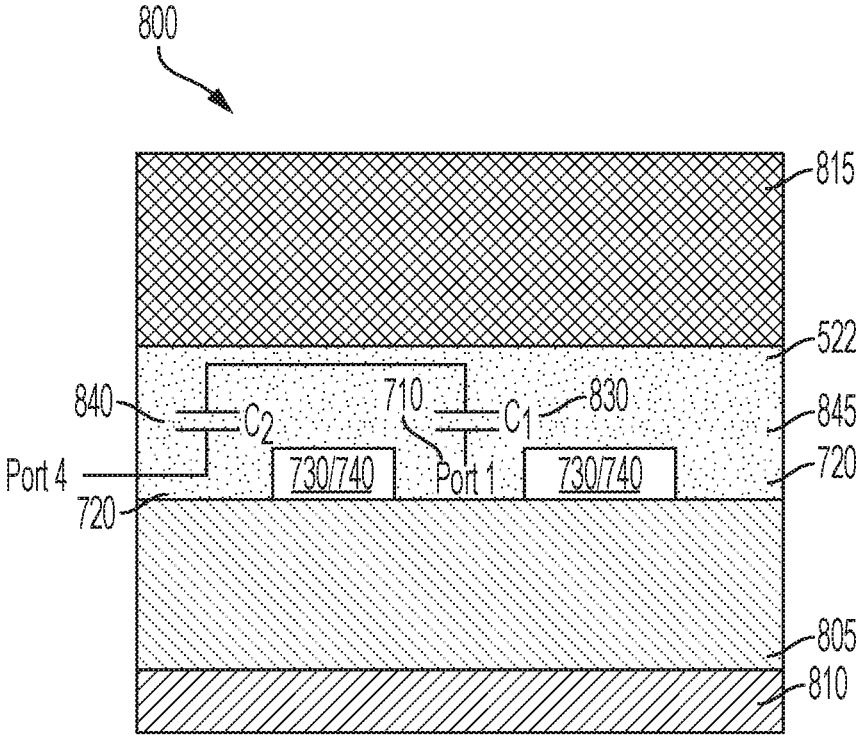
FIG. 8 is a cross sectional view of FIG. 7, depicting the capacitive components within the pivot point capacitive coupler.

FIG. 8 illustrates a cross section 800 of phase shifter 500, depicting the capacitor structure of wiper arm capacitive coupler 515. Illustrated is a phase shifter PCB substrate 805, on which is disposed a conductive ground plane 810 on a first side. Disposed on the other, or second, side of PCB substrate 805 are the portions of input port conductor plate 710 and reference port conductor plate 720. Disposed between input port conductor plate 710 and reference port conductor plate 720 are gaps, which might be first gap 730 or second gap 740.

Further illustrated is wiper arm substrate 815, on which is disposed wiper arm conductive trace 522, and solder mask 845 is disposed on wiper arm conductive trace 522, which makes physical contact with input port conductor plate 710 and reference port conductor plate 720.

As illustrated in FIG. 8, a first capacitor 830 and a second capacitor 840 are formed in series by the contact of wiper arm solder mask with input port conductor plate 710 and reference port conductor plate 720. First capacitor 830 is in series with all of the capacitive contacts for ports 2, 3, 5, and 6, as well as reference port 4. For example, for ports 2 and 5, the total capacitance is the series combination of first capacitor 830 and the capacitance formed at the structure formed by outer trace capacitor plate 540, the solder mask 845 disposed on conductive trace pattern 522 (including outer trace capacitive element 550), and outer conductive trace 505. Similarly, for ports 3 and 6, the total capacitance is the series combination of first capacitor 830 and the capacitance formed at the structure formed by inner trace capacitor plate 535, the solder mask 845 disposed on conductive trace pattern 522 (including inner trace capacitor plate 535), and inner conductive trace 510. And as already mentioned, the total capacitance at port 4 is the series combination of first capacitor 830 and second capacitor 840. Thus, by appropriately designing the structure illustrated in FIG. 7, the total capacitances at each of ports 2-6 may be balanced accordingly.

Figure 9:
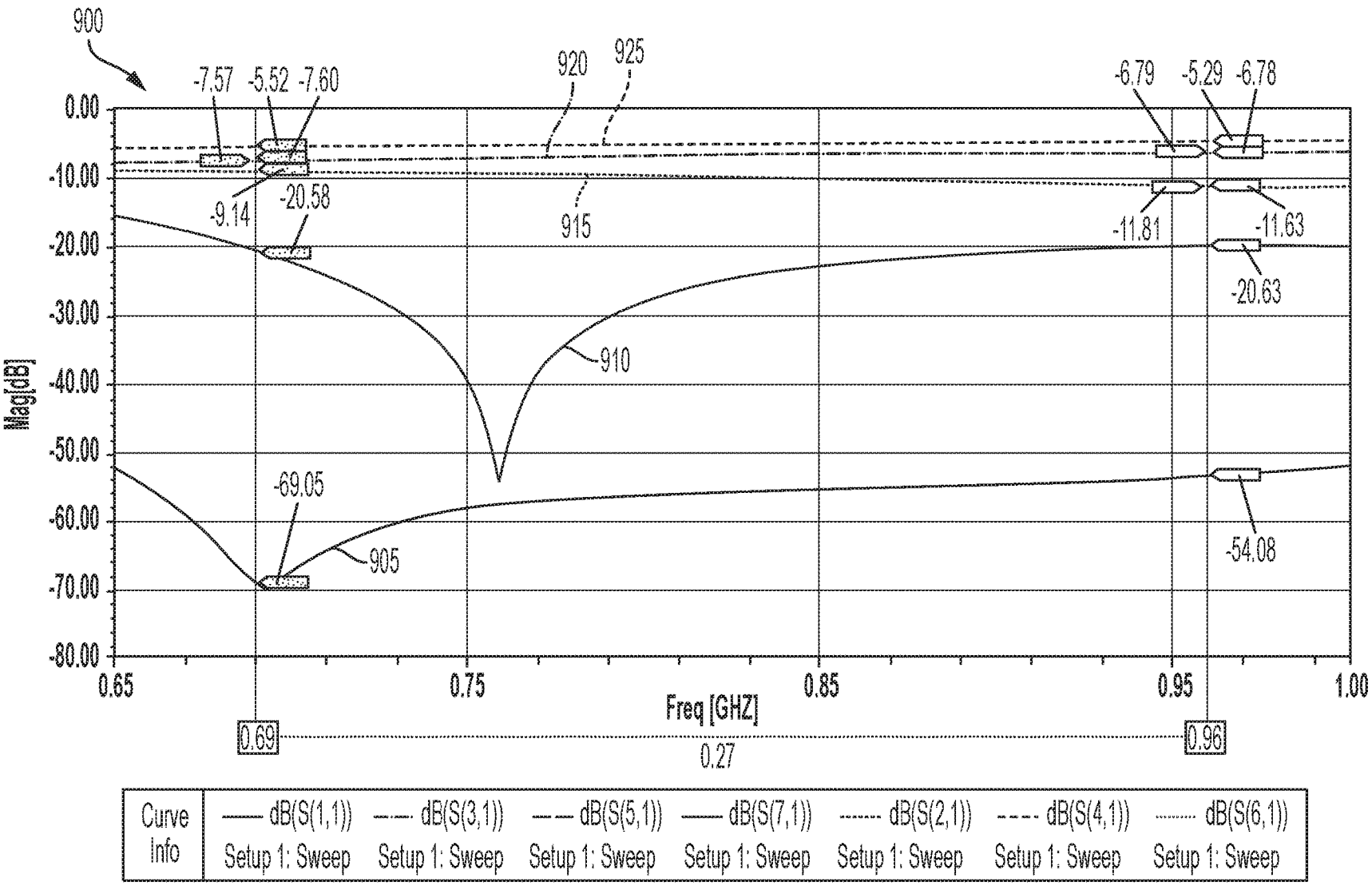
FIG. 9 illustrates a set of reflection coefficient plots, one per each output port, corresponding to an exemplary phase shifter according to the disclosure.

FIG. 9 illustrates a set of exemplary reflection coefficient and isolation plots 900 for the different ports of the disclosed phase shifter. Plot 905 represents isolation at Port 7 (the output of Bias-T 575). Plot 910 represents the reflection coefficient at input Port 1; plot 915 represents the insertion loss at Ports 2 and 5 (coupled to outer conductive trace 505); plot 920 represents the insertion loss at Ports 3 and 6 (inner conductive trace 510); and plot 925 represents the insertion loss at phase reference Port 4. The differences in insertion loss between plots 915, 920, and 925 illustrate the amplitude tapering effect designed into exemplary phase shifter 500. Accordingly, as configured, the one or more antenna radiators located at the center of the antenna array face in the elevation direction (coupled to Port 4) have the greatest amplitude; the one or more antenna radiators located adjacent to the center radiators and "above and below" the center radiators in the elevation direction (coupled to Ports 3 and 6) have a higher attenuation relative to the one or more center radiators; and the one or more antenna radiators located at the "top and bottom" ends of the array face in the elevation direction (coupled to Ports 2 and 5) have the greatest degree of attenuation. This designed amplitude tapering helps improves the antenna gain pattern 220*a/b/c*.

While various embodiments of the present invention have been described above, it should be understood that they have been presented by way of example only, and not limitation. It will be apparent to persons skilled in the relevant art that various changes in form and detail can be made therein without departing from the spirit and scope of the present invention. Thus, the breadth and scope of the present invention should not be limited by any of the above-described exemplary embodiments but should be defined only in accordance with the following claims and their equivalents.

What is claimed is:

1. A phase shifter for an antenna, comprising:
- an outer conductive trace;
- an inner conductive trace;
- a wiper arm having a wiper arm conductive trace, the wiper arm having a pivot point;
- a capacitive coupler that capacitively couples an input port to the wiper arm conductive trace and capacitively couples the input port to a phase reference port to provide DC blocking to the phase reference port; and
- a Bias-T circuit coupled to the input port via an input trace, the input trace coupled to the phase reference port via the capacitive coupler.

2. The phase shifter of claim 1, wherein the Bias-T circuit is further coupled to a wiper arm motor.

3. The phase shifter of claim 1, wherein the capacitive coupler comprises:
- an input port conductor plate that is concentric to the pivot point and is coupled to the input port; and
- a reference port conductor plate that is disposed concentric to the input conductor plate and is coupled to the phase reference port,
- wherein the input port conductor plate and the reference port conductor plate are separated by a first gap.

4. The phase shifter of claim 3, wherein the wiper arm conductive trace comprises a solder mask disposed thereon whereby the solder mask makes physical contact with the input port conductor plate and the reference port conductor plate.

5. The phase shifter of claim 1, wherein the wiper arm conductive trace comprises:
- a pivot point capacitor plate;
- an inner arm trace electrically coupled to the pivot point capacitor plate;
- an inner trace capacitor plate electrically coupled to the inner arm trace, the inner trace capacitor plate is capacitively coupled to the inner conductive trace;
- an outer arm trace electrically coupled to the inner trace capacitor plate; and
- an outer trace capacitor plate electrically coupled to the outer arm trace, the outer trace capacitor plate capactively coupled to the outer conductive trace,
- wherein the wiper arm conductive trace has disposed thereon a solder mask.

6. The phase shifter of claim 5, wherein the inner arm trace is wider than the outer arm trace.

7. The phase shifter of claim 5, further comprising an input port conductor plate that is concentric to the pivot point and is coupled to the input port and a reference port conductor plate that is disposed concentric to the input conductor plate and is coupled to the phase reference port, wherein the capacitive coupler forms a first capacitor between the input port conductor plate and the pivot point capacitor plate, and a second capacitor between the pivot point capacitor plate and the reference port conductor plate.

8. The phase shifter of claim 7, wherein the second capacitor comprises a capacitance that is substantially similar to a third capacitance formed by the inner trace capacitor plate and the inner conductive trace, and to a fourth capacitance formed by the outer trace capacitor plate and the outer conductive trace.

9. The phase shifter of claim 5, wherein the width of the inner arm trace is sized with respect to the outer arm trace such that signal amplitude at ports of the outer conductive trace is less than signal amplitude at ports of the innder conductive trace.

10. The phase shifter of claim 5, wherein a shape of the inner trace capacitor plate is an arc corresponding to an arc of the inner conductive trace and wherein the inner trace capacitor plate is between the inner arm trace and the outer arm trace.

11. The phase shifter of claim 5, wherein a shape of the outer trace capacitor plate is an arc corresponding to an arc of the outer conductive trace and wherein the outer trace capacitor plate is at a distal end of the outer arm trace.

12. A phase shifter for an antenna, comprising:
- an outer conductive trace;
- an inner conductive trace;
- a wiper arm having a wiper arm conductive trace, the wiper arm having a pivot point; and
- a capacitive coupler that capacitively couples an input port to the wiper arm conductive trace and capacitively couples the input port to a phase reference port to provide DC blocking to the phase reference port;
- wherein the wiper arm conductive trace comprises:
  - a pivot point capacitor plate;
  - an inner arm trace electrically coupled to the pivot point capacitor plate;
  - an inner trace capacitor plate electrically coupled to the inner arm trace, the inner trace capacitor plate is capacitively coupled to the inner conductive trace;

an outer arm trace electrically coupled to the inner trace capacitor plate;

and an outer trace capacitor plate electrically coupled to the outer arm trace, the outer trace capacitor plate capactively coupled to the outer conductive trace, wherein the wiper arm conductive trace has disposed thereon a solder mask; and further comprising an input port conductor plate that is concentric to the pivot point and is coupled to the input port and a reference port conductor plate that is disposed concentric to the input conductor plate and is coupled to the phase reference port, wherein the capacitive coupler forms a first capacitor between the input port conductor plate and the pivot point capacitor plate, and a second capacitor between the pivot point capacitor plate and the reference port conductor plate.

13. The phase shifter of claim 12, wherein the second capacitor comprises a capacitance that is substantially similar to a third capacitance formed by the inner trace capacitor plate and the inner conductive trace, and to a fourth capacitance formed by the outer trace capacitor plate and the outer conductive trace.

* * * * *